US005308398A

United States Patent [19]

Öttl et al.

[11] Patent Number: 5,308,398

[45] Date of Patent: May 3, 1994

[54] DEVICE FOR THE CONTACT-FREE APPLICATION OF A STRIP OF LIQUID TO A MOVING WEB OF MATERIAL

[75] Inventors: Josef Öttl, Diedorf; Karl-Heinz Reichel-Langer, Zusmarshausen, both of Fed. Rep. of Germany

[73] Assignee: Grafotec Kotterer GmbH, Diedorf, Fed. Rep. of Germany

[21] Appl. No.: 895,124

[22] Filed: Jun. 8, 1992

[30] Foreign Application Priority Data

Jul. 4, 1991 [DE] Fed. Rep. of Germany ..... 4122105

[51] Int. Cl.[5] ..... B05B 12/02; B05B 12/10

[52] U.S. Cl. ..... 118/674; 118/682; 118/684; 118/697; 118/698; 118/703; 118/712; 118/325; 364/469

[58] Field of Search ..... 118/682, 684, 685, 697, 118/698, 699, 703, 712, 325, 674; 364/469, 479

[56] References Cited

U.S. PATENT DOCUMENTS

| | | | |
|---|---|---|---|
| 3,532,907 | 10/1970 | Kasper | 118/703 |
| 3,969,779 | 7/1976 | Stewart, Jr. | 118/697 |
| 4,164,001 | 8/1979 | Patnaude | 118/684 |
| 4,380,967 | 4/1983 | Matt | 118/703 |
| 4,389,971 | 6/1983 | Schmidt | 118/684 |
| 4,421,800 | 12/1983 | Schoenberg et al. | 118/684 |
| 4,527,510 | 7/1985 | Arndt | 118/684 |
| 4,530,862 | 7/1985 | Kerzel | 118/703 |
| 4,578,965 | 4/1986 | Brossman | 118/697 |
| 4,979,380 | 12/1990 | Robbins et al. | 118/697 |
| 4,984,169 | 1/1991 | Johnson, Jr. | 118/697 |

*Primary Examiner*—W. Gary Jones
*Assistant Examiner*—Todd J. Burns
*Attorney, Agent, or Firm*—Harrison & Egbert

[57] ABSTRACT

In the case of an apparatus for the contact-free application of a liquid strip, more particularly a strip of glue, on a moving web of material, comprising at least one application head, which is provided with at least one nozzle arranged at a distance from the web of material and a valve adapted to put the nozzle into and out of operation and adapted to be operated in accordance with the desired pattern of application, the aim of the invention is to provide such an improvement using simple and low-price means that despite the contact-free application of liquid high accuracy becomes possible. This accomplished by a modification such that the timing of the valve is modified to depart from the basic values, which are dependent on the application pattern, in accordance with a correction value which is a function of the speed of the web of material and at least the distance of the web from the nozzle.

7 Claims, 1 Drawing Sheet

Figure 1:
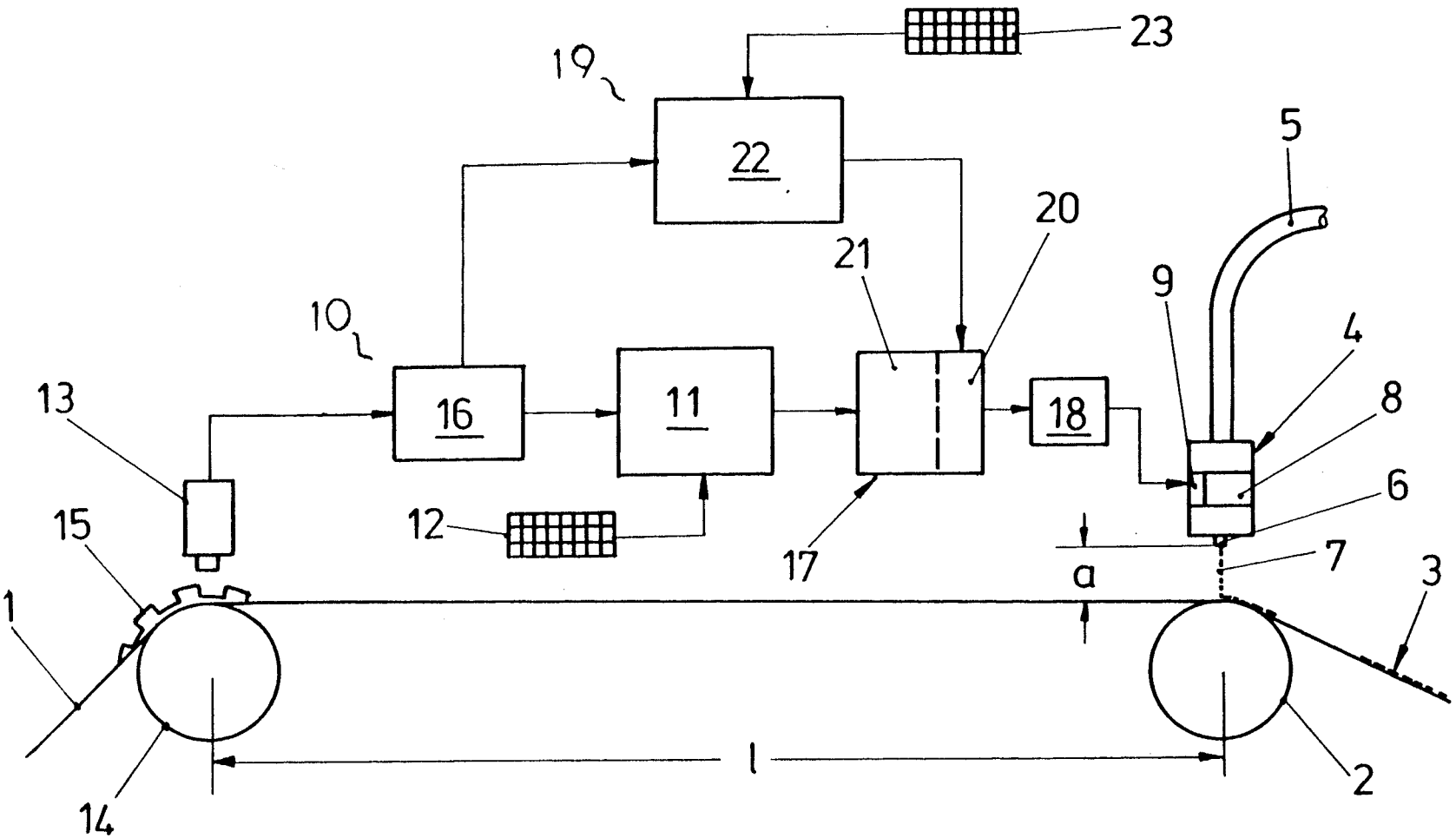

DEVICE FOR THE CONTACT-FREE APPLICATION OF A STRIP OF LIQUID TO A MOVING WEB OF MATERIAL

BACKGROUND OF THE INVENTION

The present invention relates to an apparatus for the contact-free application of a liquid strip, more particularly a strip of glue, on a moving web of material, comprising at least one application head, which is provided with at least one nozzle arranged at a distance from the web of material and a valve adapted to put the nozzle into and out of operation and adapted to be operated in accordance with the desired pattern of application.

An apparatus of this type, has been proposed, see the German patent publication 3,740,045 A1, in which case the continuous application of liquid is however only possible with many problems as regards wear and insufficient freedom from failure. Such apparatus has however been evolved on the basis of device in the case of which the nozzle makes contact with the web. This is the reason why so far the valve is operated in a manner ignoring the distance between the web and the nozzle. The consequence of this is that with an increasing speed of the web ever increasing errors as regards the start and the end of the applied strip of liquid have to be tolerated, this being something which is more particularly disadvantageous in the case of the application of glue.

SHORT SUMMARY OF THE INVENTION

Taking this prior art as a starting point one object of the present invention is to provide a device of the type initially mentioned which is so improved using simple and low-price means that despite the contact-free application of liquid high accuracy becomes possible.

In order to achieve these and/or other objects appearing from the present specification, claims and drawings, in the present invention the timing of the valve is modified to depart from the basic values, which are dependent on the application pattern, in accordance with a correction value which is a function of the speed of the web of material and at least the distance of the web from the nozzle.

By adopting these features it is possible to compensate for the flight time of the liquid from the nozzle to the web completely. The features in accordance with the invention therefore lead to a high accuracy while maintaining the advantages of contact-free application of the liquid.

The claims indicate further advantageous developments of the invention. Thus it is possible for instance for the basic values dependent on the application pattern to be ascertained by the intermediary of a program control device clocked by a sensor responsive to the web, said program control device being coupled in series with an auxiliary control device ascertaining the correction value. The arrangement in series in accordance with the invention leads to the advantage of simple feedback and is furthermore responsible for a particularly high degree of accuracy. It is an advantage in this respect that it is possible to derive from the beats supplied by the sensor both the speed and also the factors thereof so that there is the advantage that despite the speed dependence of the correction value and the position dependence of the basic value only one sensor with a following signal processing means is necessary.

In accordance with a further advantageous feature the auxiliary control device comprises an input unit for manual input of the parameters entering into the correction value. This renders possible a high variability and adaptation while at the same time ensuring great ease of use.

In accordance with a further possible advantageous development the auxiliary control device may be so designed that a time factor is derived from the parameters input into the auxiliary device, such factor being multiplied by the speed of the web, the correction value being produced in the form of a certain number of beats, which may be subtracted from the delay, dependent on the distance, also in the form of a number of beats. This renders possible a particularly simple system of circuitry.

In addition to the distance of the nozzle from the web it is possible to use as parameters the viscosity and the pressure of the liquid and preferably furthermore the time lag of the valve. Taking into account such a plurality of parameters is responsible for a particularly high degree of accuracy. Owing to taking the time lag into account there is the advantage of compensating not only for the flight time of the liquid but also the delay of the valve.

In what follows one embodiment of the invention will be described with reference to the accompanying drawing, whose single FIGURE is a block circuit diagram of the novel apparatus.

DETAILED ACCOUNT OF WORKING EMBODIMENT OF THE INVENTION.

The web 1 of material indicated in the FIGURE may for instance be a printed paper web, which is on its way to a folder. An interrupted strip 3 of glue constituting the applied liquid is placed on the web 1 of the material at the inlet to the folder in the form of a bend roll 2. With such application of glue it is possible for the superposed webs of a stack of webs to be connected together along a line.

For the application of the glue strip 3 there is an application head 4 over the bend roll 2, around which the web 1 is trained, such head being connected with a feed line 5 and having a nozzle 6, from which a thin jet 7 of glue is squirted onto the web 1. The nozzle 6 is spaced from the web 1 of material. The distance is denoted a in the FIGURE. Since nozzle 6 does not come into contact with the web 1 of material a high degree of freedom from failure and wear is ensured. For turning the nozzle 6 on and off it is associated with a feed valve 8 which in the present case is integrated in the application head 4 and which for instance may be in the form of an electromagnetically operated spool valve.

In order to control the actuating device 9, which is constituted by an electromagnet, of the valve 8 a program control device 10 is provided. The same comprises as its main computer module a freely programmable memory 11, in which the desired glue pattern is able to be stored in the form of data relating to the length and spacing of the interrupted glue strip 3 constituted by the dashes of glue or, respectively, the timing data of the valve 8. For this purpose the memory 11 is provided with an input device 12. The program control device 10 is timed by means of a sensor 13 operated in a way dependent on the course of the web. In this respect it may be in the form of an angle encoder, which senses an incremental disk 15 connected with the bend roll 14 with the web 1 of the material trained around it. The sensor 13 is followed by signal processor 16, which so prepares the pulses received by the sensor 13 that a completely regular pulse form is produced, as for instance a rectangular pulse form. Each displacement of the web 1 of material may be represented by the number of pulses occurring during such displacement.

The points in time for turning the value on and off are set by suitable counting means integrated in the memory 11 using the values stored in the memory 11 and the pulse from the sensor 13. The displacement, indicated by the distance l, which the web 1 of material moves between the sensor 13 and the nozzle 6, is in this case taken into account by a delay means 17 following the memory 11. This delays the switching signals received from the memory 11 by the number of pulses corresponding to the distance 1 from the sensor 13. The output of the delay means 17 is connected via a power amplifier 18 with the valve actuating device 9.

Since the nozzle 6 is at the distance a from the web 1 of material, the glue jet 7 needs a certain time in order to move through the distance a. Within this flight time however the web 1 of material will move on farther. In order to ensure a high degree of accuracy it is therefore necessary for the flight time to be taken into account for ascertaining or determining the points in time of operation of the valve 8. For this purpose the above noted delay, corresponding to the distance 1, in conduction of the switching signals is suitably shortened.

In order to produce this effect on the output of the delay means 17 there is an auxiliary control device 19 coupled in series with the program control device 10. The signal processing means 16 is in this respect so designed that output signals corresponding not only to the position but also to the speed of the web 1 of material are produced. The signal processing means is provided with two outputs with which the memory 11 and, respectively, series arrangement comprising the auxiliary control device are connected. The number of pulses, that is to say a position signal, will be present at the output associated with the memory 11. A signal in the form of the pulse rate will be present at the output of the auxiliary control device 19.

With the aid of the auxiliary control device 19 the signal for the speed of the web 1 of material gotten f rom the signal processing device 16 is multiplied by a time factor corresponding to the desired correction. The result of this calculation is a certain number of pulses by which the above noted delay corresponding to the displacement 1 has to be shortened. This subtraction takes place in the delay means 17, which for this purpose may comprise an integrated comparator 20, whose one input is connected with the output of the series circuit arrangement comprising the auxiliary control device 19 and whose further input is connected with the output of the adjacent delay means 17. Accordingly the delay means 17 comprising the comparator and the delay device 21 has two inputs, of which one is associated with the memory 11 and the other is associated with the auxiliary control device 19.

The auxiliary control device 19 comprises a calculating device 22 preferably coupled with a memory and which is associated with an input device 23 for the manual input of the parameters entering into the above noted time factor. The parameter is primarily the distance a between the nozzle 6 and the web 1 of material. Further parameters may be the viscosity of the glue and the pressure in the feed line 5. Since the valve 8 and the valve actuating device 9 involve a certain time lag between the arrival of a switching signal and the performance of a switching operation, this time lag can as well be used as a parameter. If all parameters are utilized a more particularly high degree of overall accuracy can be expected.

From the following example of a calculation the simple manner of operation of the device in accordance with the invention will be made more particularly clear. In this example the speed signal for the web 1 of material at the output, associated with the auxiliary control device 19, is to be $15 \cdot 10^3$ pulses per second. The time factor as ascertained from the simple parameter with the aid of an operating program comprised in the calculating device 22 is $10^{-3}$ second. The multiplication to be performed by the calculating device 22 accordingly leads to a correction value of 15 pulses. The basic value in the form of the delay, produced with the aid of the delay device 21 of the switching signals taken from the memory 11 has to be shortened by this correction value. The distance 1 is to equal to 150 pulses. Thus with the aid of the delay means 17 the switching signals from the memory 11 are not delayed by the said basic value of 150 pulses but only by the difference between the basic value and the correction value, that is to say only by 135 pulses so that the flight time and the time lag are compensated.

We claim:

1. An apparatus for the contact-free application of a liquid strip, on a moving web of material, comprising at least one application head, which is provided with at least one nozzle arranged at a distance from the web of material and a valve adapted to put the nozzle into and out of operation and adapted to be operated in accordance with the desired pattern of application, wherein the timing of the valve is modified to depart from basic values, which are dependent on the application pattern, in accordance with a correction value which is a function of the speed of the web of material and at least the distance of the web from the nozzle, the apparatus further comprising a sensor adapted to respond to the web of material and a program control device adapted to be timed by said sensor, said program control device being coupled in series with an auxiliary control device for determining the correction value, said auxiliary control device comprising a calculating device with an input device for manual input of parameters entering into the correction value, the apparatus further comprising means adapted to derive a time factor from the parameters and means to multiply such time factor by the speed of the web of material so as to produce the correction value, the correction value being subtracted by a comparator from the basic values which are a function of the distance of the web from the nozzle.

2. The application as claimed in claim 1, wherein said program control device comprises a delay means connected with the valve, said delay means having two inputs connected to a programmable memory containing the application pattern and the auxiliary control device.

3. The apparatus as claimed in claim 2, comprising in said delay means a delay device, the delay device being adapted to delay the basic values, which may be recovered from the memory, for the timing of the valve in a way dependent on a pulse rate, which is a function of the distance between the sensor and the nozzle, of the sensor, such delay being able to be reduced with the aid of the comparator by the amount of an output value of the auxiliary control device.

4. The apparatus as claimed in claim 1, comprising a signal processing means connected with an output of the sensor and having an output associated with the speed of the web of material, with which output the auxiliary control device is connected and having an output associated with the position, with which output the memory is connected.

5. The apparatus as claimed in claim 1, wherein said sensor is constituted by an angle encoder which associated with a bend roll around which the web of material is at least partly trained.

6. The apparatus as claimed in claim 1, comprising means adapted for the input of an additional parameter besides the distance of the nozzle from the web of material, such additional parameter including at least the time lag of the valve and its actuating device.

7. The apparatus as claimed in claim 1, comprising means adapted for the input of parameters, besides the web distance, including the viscosity and the pressure of the liquid.

* * * * *